US011421904B2

(12) United States Patent
Mao et al.

(10) Patent No.: US 11,421,904 B2
(45) Date of Patent: Aug. 23, 2022

(54) SYSTEMS AND METHODS FOR SMART MULTI-ZONE CONTROL

(71) Applicant: Johnson Controls Technology Company, Auburn Hills, MI (US)

(72) Inventors: Bing Mao, Buffalo Grove, IL (US); Wensu Lu, Buffalo Grove, IL (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 426 days.

(21) Appl. No.: 16/417,207

(22) Filed: May 20, 2019

(65) Prior Publication Data

US 2019/0353377 A1 Nov. 21, 2019

Related U.S. Application Data

(60) Provisional application No. 62/674,425, filed on May 21, 2018.

(51) Int. Cl.

| | |
|---|---|
| ***F24F 11/49*** | (2018.01) |
| ***F24F 11/58*** | (2018.01) |
| ***F24F 11/62*** | (2018.01) |
| ***F24F 11/74*** | (2018.01) |
| ***F24F 11/79*** | (2018.01) |
| *F24F 140/50* | (2018.01) |
| *F24F 110/10* | (2018.01) |
| *F24F 140/40* | (2018.01) |

(52) U.S. Cl.

CPC ..... *F24F 11/49* (2018.01); *F24F 11/58* (2018.01); *F24F 11/62* (2018.01); *F24F 11/74* (2018.01); *F24F 11/79* (2018.01); *F24F 2110/10* (2018.01); *F24F 2140/40* (2018.01); *F24F 2140/50* (2018.01)

(58) Field of Classification Search

CPC .... F24F 11/62; F24F 2110/00; F24F 2110/10; F24F 2110/12

See application file for complete search history.

(56) References Cited

U.S. PATENT DOCUMENTS

2015/0369507 A1* 12/2015 Flaherty ..... F24F 11/64 236/1 B
2017/0343227 A1* 11/2017 Mowris ..... F24F 11/0001

OTHER PUBLICATIONS

U.S. Appl. No. 62/674,425, filed May 21, 2018, Johnson Controls Technology Company.

* cited by examiner

*Primary Examiner* — Nelson J Nieves
*Assistant Examiner* — Meraj A Shaikh
(74) *Attorney, Agent, or Firm* — Foley & Lardner LLP

(57) ABSTRACT

Systems and methods for smart multi-zone control are provided. The system can include a plurality of sensors, a plurality of dampers, and a controller. The plurality of sensors can be configured to sense temperatures of a plurality of zones. The plurality of dampers can be configured to control the temperatures of the plurality of zones. The controller can be configured to obtain a first array associated with the plurality of sensors. Each element in the first array can represent a difference between a measurement value of a respective sensor and a setpoint associated with the respective sensor. The controller can be configured to obtain a second array associated with the plurality of dampers. Each element in the second array can represent a damper position of a respective damper. The controller can be configured to determine values of entries of a matrix using the first array and the second array.

19 Claims, 7 Drawing Sheets

SYSTEMS AND METHODS FOR SMART MULTI-ZONE CONTROL

CROSS-REFERENCE TO RELATED APPLICATIONS

This application claims priority to and the benefit of U.S. Provisional Patent Application No. 62/674,425, filed May 21, 2018, the entire disclosure of which is incorporated by reference herein.

BACKGROUND

The present disclosure relates generally to multi-zone thermostats, and more particularly to the control of a building or space's heating, ventilating, and air conditioning (HVAC) system using a multi-zone thermostat with neural network based control process and pluggable sensor frame work.

Traditionally, the control of a building or space's HVAC system is through the use of a thermostat which can be designed to control a heating or cooling system or an air conditioner. A thermostat can sense the temperature or other parameters (e.g., humidity) of a system and control components of the HVAC system in order to maintain a set point for the temperature or other parameters.

Conventional thermostats are configured for one-way communication to connected components, and to control HVAC systems by turning on or off certain components or by regulating flow. Each thermostat may include a temperature sensor and a user interface. The user interface typically includes a display for presenting information to a user and one or more user interface elements for receiving input from a user. To control the temperature of a building or space, a user adjusts the set point via the thermostat's user interface.

SUMMARY

One implementation of the present disclosure is a system for multi-zone control. The system can include a plurality of sensors configured to sense temperatures of a plurality of zones. The system can include a plurality of dampers configured to control the temperatures of the plurality of zones by adjusting respective damper positions. The system can include a controller. The controller can be configured to obtain a first array associated with the plurality of sensors. Each element in the first array represents a difference between a measurement value of a respective sensor and a setpoint associated with the respective sensor. The controller can be configured to obtain a second array associated with the plurality of dampers. Each element in the second array represents a damper position of a respective damper. The controller can be configured to determine values of entries of a matrix using the first array and the second array.

In some embodiments, the controller can be configured to obtain the first array by: obtaining a measurement value of each sensor of the plurality of sensors; obtaining a setpoint associated with each sensor of the plurality of sensors; determining a difference between the respective measurement value and the respective setpoint for each sensor; determining that a total number of the plurality of sensors in the plurality of zones is N, where N is an integer; generating the first array having N number of elements; and assigning the respective difference between the respective measurement value and the respective setpoint to a respective element of the first array.

In some embodiments, the controller can be configured to obtain the second array by: obtaining a damper position of each damper of the plurality of dampers; determining that a total number of the plurality of dampers in the plurality of zones is M, where M is an integer; generating the second array having M number of elements; and assigning a respective damper position associated with each damper to a respective element of the second array. In some embodiments, the damper position is obtained based on a signal received from an actuator associated with the respective damper.

In some embodiments, the controller can be configured to determine that a total number of the plurality of sensors in the plurality of zones is N, where N is an integer. The controller can be configured to generate the first array having N number of elements. The controller can be configured to determine that a total number of the plurality of dampers in the plurality of zones is M, where M is an integer. The controller can be configured to generate the second array having M number of elements. The controller can be configured to generate the matrix having N times M entries.

In some embodiments, the values of the entries of the matrix can be determined by adjusting the damper positions of the dampers associated with the second array to detect changes in values of the elements in the first array.

In some embodiments, the controller can be configured to determine the damper positions of the plurality of dampers using the values of the entries of the matrix responsive to a request to adjust temperature in a first zone associated with a first sensor. In some embodiments, the damper positions of the plurality of dampers are determined further based at least in part on a difference between a temperature sensed by the first sensor and a setpoint associated with the first sensor.

In some embodiments, the controller can be configured to instruct HVAC equipment to adjust damper positions based on the determined damper positions to control the temperature of the first zone.

Another implementation of the present disclosure is a method for multi-zone control. The method includes obtaining, by a controller, a first array associated with a plurality of sensors configured to sense temperatures of a plurality of zones. Each element in the first array represents a difference between a measurement value of a respective sensor and a setpoint associated with the respective sensor. The method includes obtaining, by the controller, a second array associated with a plurality of dampers configured to control the temperatures of the plurality of zones by adjusting respective damper positions. Each element in the second array represents a damper position of a respective damper. The method includes determining, by the controller, values of entries of a matrix using the first array and the second array.

In some embodiments, obtaining the first array further includes obtaining a measurement value of each sensor of the plurality of sensors; obtaining a setpoint associated with each sensor of the plurality of sensors; determining a difference between the respective measurement value and the respective setpoint for each sensor; determining that a total number of the plurality of sensors is N, where N is an integer; generating the first array having N number of elements; and assigning the respective difference between the respective measurement value and the respective setpoint to a respective element of the first array.

In some embodiments, obtaining the second array further includes obtaining a damper position of each damper of the plurality of dampers; determining that a total number of the plurality of dampers is M, wherein M is an integer; generating the second array having M number of elements; and assigning a respective damper position associated with each damper to a respective element of the second array.

In some embodiments, the method includes determining that a total number of the plurality of sensors is N, where N is an integer. The method includes generating the first array having N number of elements. The method includes determining that a total number of the plurality of dampers is M, where M is an integer. The method includes generating the second array having M number of elements. The method includes generating the matrix having N times M entries. The method includes determining the values of the entries of the matrix by adjusting damper positions of the dampers associated with the second array to detect changes in values of the elements in the first array.

In some embodiments, the method includes determining the damper positions of the plurality of dampers using the values of the entries of the matrix responsive to a request to adjust temperature in a first zone associated with a first sensor. In some embodiments, the damper positions of the plurality of dampers are determined further based at least in part on a difference between a temperature sensed by the first sensor and a setpoint associated with the first sensor.

In some embodiments, the method includes instructing, by the controller, HVAC equipment to adjust damper positions based on the determined damper positions to control the temperature of the first zone.

Another implementation of the present disclosure is a method for multi-zone control. The method includes receiving a request to adjust temperature in a first zone associated with a first sensor. The first zone is among a plurality of zones, and the first sensor is among a plurality of sensors configured to sense temperatures of a plurality of zones. The method includes retrieving a matrix having a plurality of entries responsive to receiving the request. The method includes determining a damper position of a damper associated with the first sensor based on an entry in the matrix and a difference between a temperature sensed by the first sensor and a setpoint associated with the first sensor.

In some embodiments, the entry in the matrix corresponds to the damper and the first sensor.

In some embodiments, the matrix has N times M entries, where N and M are integers, and a total number of the plurality of sensors is N. In some embodiments, the plurality of zones include M dampers, and the damper is among the M dampers.

In some embodiments, the method includes instructing HVAC equipment to adjust the damper position of the first damper based on the determined damper position to control the temperature of the first zone.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing.

DETAILED DESCRIPTION

Following below are more detailed descriptions of various concepts related to, and implementations of systems, methods, and apparatuses of smart multi-zone control with neural network based control process and pluggable sensor framework. Before turning to the more detailed descriptions and figures, which illustrate the exemplary implementations in detail, it should be understood that the application is not limited to the details or methodology set forth in the descriptions or illustrated in the figures. It should also be understood that the terminology is for the purpose of description only and should not be regarded as limiting.

With the increasing availability and capacity of wireless sensors and wireless communication networks, wireless sensors are becoming a viable alternative to wired sensors. The portability of the wireless sensors allow users to place the sensors at many spots in a home. As can be understood, temperature in the kitchen may be very different from temperature in the basement. Even in the same room, such as a large living room, different spots may have different temperatures. By using multiple portable wireless sensors to detect temperatures at different spots, the HVAC system may be able to adjust temperatures more accurately, providing a more comfortable environment to users.

However, in order to have the HVAC system to work with multiple sensors or adding more sensors, many configurations are required. For example, a user is required to configure which sensor corresponds to which damper in a home. When multiple wireless sensors are added to the system, such a configuration can be very tedious and may require special skills. Furthermore, a control algorithm may need a clearly defined sensors/dampers mapping to each zone. This can require complicated configuration and it can be hard for the control algorithm to support arbitrary combinations, and in certain cases, some dampers or sensors are not even clearly belong to a certain zone. Systems and methods of the present disclosure can solve the above discussed problems by using a neural network based control process as described herein below. Furthermore, an android based plugin framework can allow a HVAC system use wireless sensors from different manufactures, further enabling the systems and methods of the present disclosure to optimize the utilization of wireless sensors.

Figure 1:
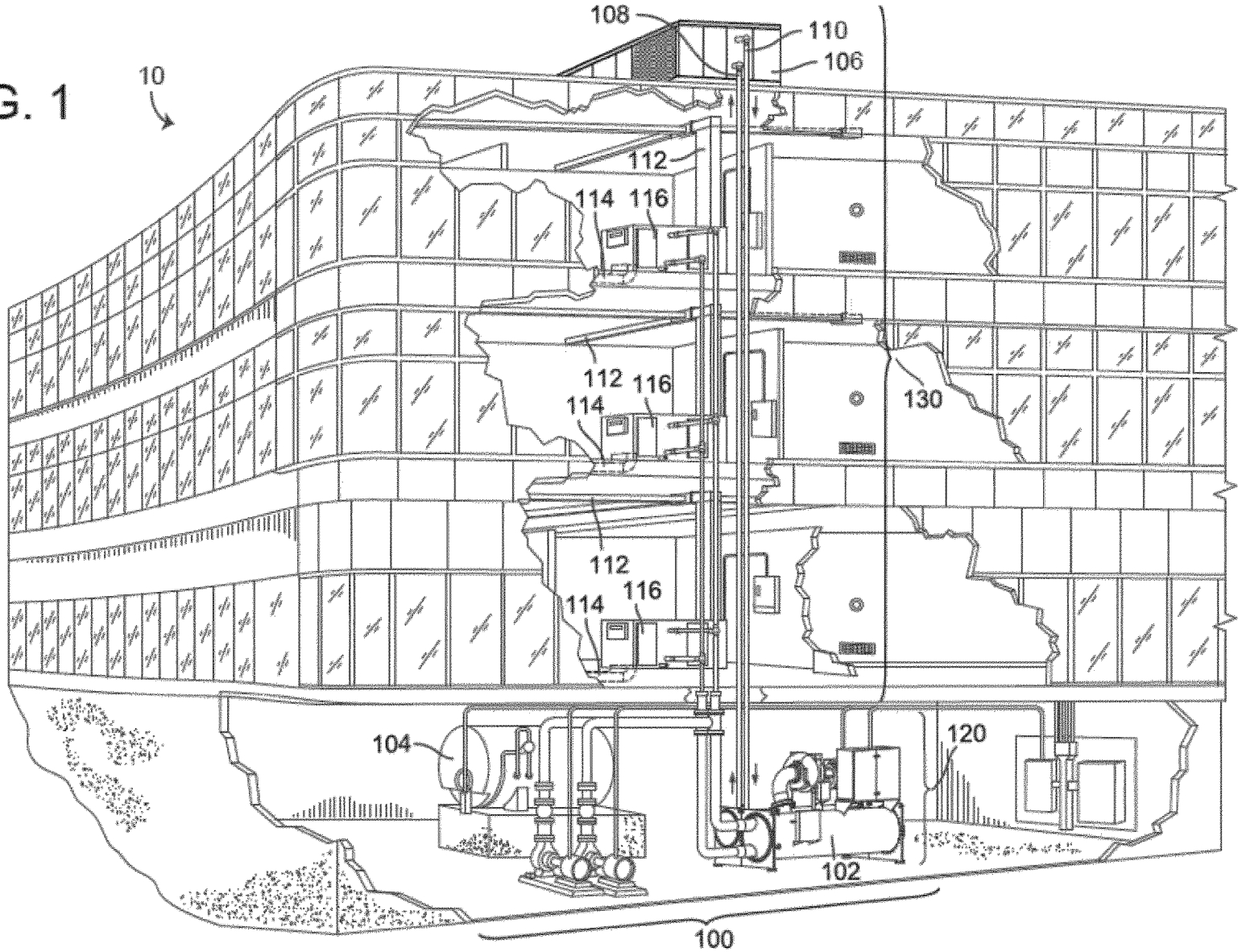
FIG. 1 is a drawing of a building equipped with a HVAC system in which the systems and methods of the present disclosure may be implemented, according to an exemplary embodiment.

FIG. 1 is a drawing of a building 10 equipped with a HVAC system in which the systems and methods of the present disclosure may be implemented, according to an exemplary embodiment. Referring to FIG. 1, a perspective view of a building 10 is shown. Building 10 is served by a HVAC system 100. HVAC system 100 may include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 may be located in or around building 10 (as shown in FIG. 1) or at an offsite location such as a central plant (e.g., a chiller plant, a steam plant, a heat plant, etc.). The working fluid may be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 may be transported to AHU 106 via piping 108.

AHU 106 may place the working fluid in a heat exchange relationship with an airflow passing through AHU 106 (e.g., via one or more stages of cooling coils and/or heating coils). The airflow may be, for example, outside air, return air from within building 10, or a combination of both. AHU 106 may transfer heat between the airflow and the working fluid to provide heating or cooling for the airflow. For example, AHU 106 may include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 may include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 may include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Figure 2:
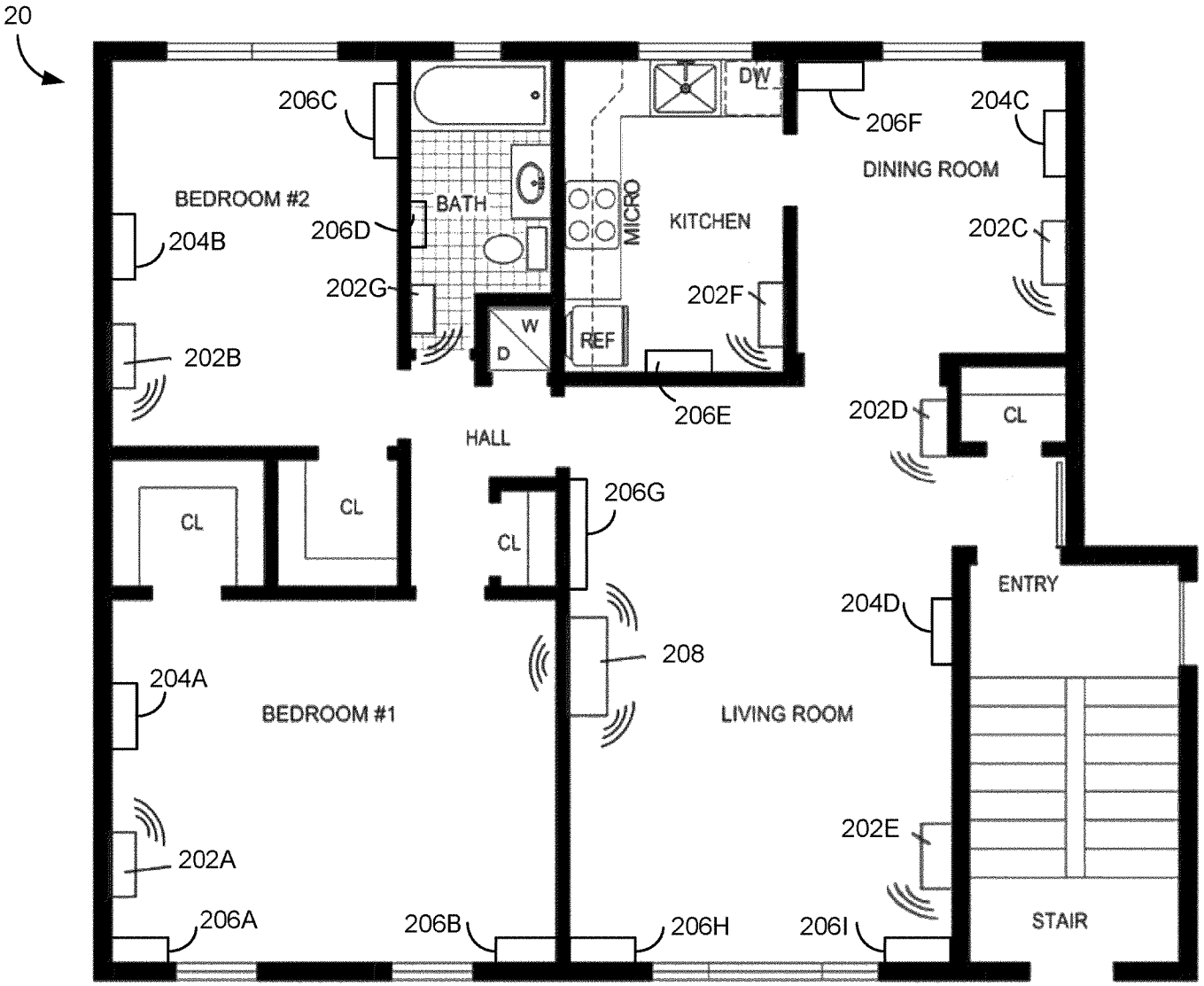
FIG. 2 is a block diagram illustrating a unit including multiple zones in which the systems and methods of the present disclosure may be implemented, according to an exemplary embodiment.

FIG. 2 is a block diagram illustrating a unit 20 including multiple zones in which the systems and methods of the present disclosure may be implemented, according to an exemplary embodiment. Referring to FIG. 2, a unit 20 can be a house, a floor in a house, an apartment in an apartment building, an office in an office building, or any other units that include multiple rooms, zones, or spaces. As shown in FIG. 2, the unit 20 may include a space controller 208 and each room, zone, or space of unit 20 may include one or more sensors 202 (e.g., one or more sensors 202A-G) and one or more dampers 206 (e.g., one or more sensors 206A-I). Each sensor 202 may be associated with a mechanism (e.g., a thermostat) for setting desired setpoints for temperature, humidity, mode, etc. In some embodiments, a sensor 202 may include the mechanism for setting desired setpoints (e.g., the mechanism for setting desired setpoints and sensor 202 may be integrated into one device). In other embodiments, the mechanism for setting desired setpoints may be a separate device, such as setpoint units 204 (e.g., 204A-D). In some embodiments, the mechanism for setting desired setpoints may be associated with two or more sensors. For example, a room may include multiple wired or wireless sensors and one mechanism for setting desired setpoints (e.g., a thermostat). In this example, the multiple sensors may be associated with the one mechanism for setting desired setpoints. For example, as shown in FIG. 2, in the living room, setpoint unit 204D may be associated with both sensor 202D and sensor 202E. While not shown, the unit 20 can be served by a HVAC system, such as the HVAC system 100 in FIG. 1 or a HVAC system that may include less, more, or different equipment than the HVAC system 100. In some embodiments, features of the present disclosure can be combined with features described in U.S. Provisional Patent Application No. 62/756,905 Filed Nov. 7, 2018, the entirety of which is incorporated by reference herein.

Sensors 202 can be wired or wireless sensors configured to monitor a variety of building conditions such as temperature, humidity, pressure, airflow, etc. In some embodiments, the sensor 202 may be a sensor that senses only one or a few conditions. For example, a sensor 202 may be a temperature sensor only, or a temperature and humidity sensor, or a sensor that senses temperature, humidity and air quality. In other embodiments, a sensor 202 may be a sensor unit that includes a plurality of sensors, such as one or more of a temperature sensor, a humidity sensor, an air quality sensor, a smoke sensor, a fire sensor, a water leakage sensor, a vibration sensor, a light sensor, a camera, and a microphone. In some embodiments, sensor 202 can be configured to communicate with a controller (e.g., space controller 208) or other components in the HVAC via a communications link. For example, wireless sensor 202 can communicate with the controller or other components in the HVAC system via WiFi, ZigBee, SA Bus, Bluetooth, NFC, etc.

Dampers 206 can be wired or wireless dampers. In general, a damper can be a valve or plate that stops or regulates the flow of air inside a duct, VAV unit, air handler, or other air-handling equipment. A damper 206 may be operated by an actuator. In some embodiments, the actuator may communicate with a controller (e.g., space controller 208) via a communications link. Actuators may receive control signals from the controller and may provide feedback signals to the controller. Feedback signals may include, for example, an indication of a current actuator or damper position, an amount of torque or force exerted by the actuator, diagnostic information (e.g., results of diagnostic tests performed by actuators), status information, commissioning information, configuration settings, calibration data, and/or other types of information or data that may be collected, stored, or used by actuators.

Figure 3:
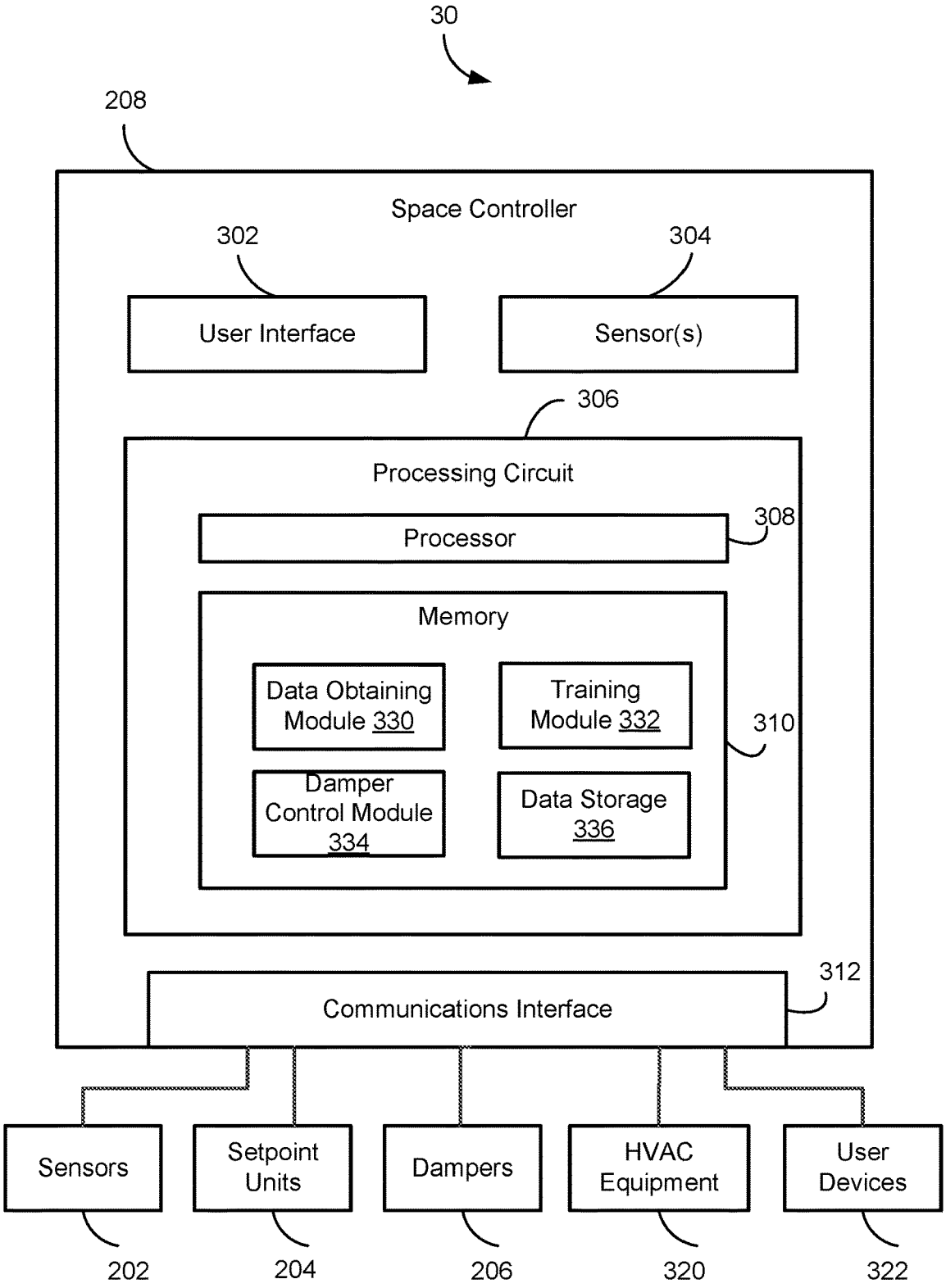
FIG. 3 is a block diagram illustrating a space controller, according to an exemplary embodiment.

FIG. 3 is a block diagram 30 illustrating the space controller 208 of FIG. 2, according to an exemplary embodiment. Referring FIGS. 2 and 3 together, unit 20 includes a space controller 208 which can communicate with sensors 202, setpoint units 204, and dampers 206 via a communication link which can be wired or wireless. In some embodiments, space controller 208 may also communicate with one or more user devices 322 (e.g., smart phones, laptops, tablets) and HVAC equipment (e.g., equipment other than dampers 206, etc). In some embodiments, space controller 208 can be a standalone device (e.g., a standalone portable device) or integrated into a user device (e.g., a smart phone, a laptop, a tablet). As shown in FIG. 3, the space controller 208 may include a user interface 302, one or more sensors 304, a processing circuit 306, and a communications interface 312. The user interface 302 may be configured to receive input from a user and provide output to a user in various forms. For example, the user interface 302 may include a touch-sensitive panel, an electronic display, ambient lighting, speakers, and haptic feedback generators, a microphone configured to receive voice commands from a user, a keyboard or buttons, switches, dials, or any other user-operable input devices. The user interface 302 may include any type of device configured to receive input from a user and/or provide an output to a user in any of a variety of forms (e.g., touch, text, video, graphics, audio, vibration, etc.).

The sensors 304 can be similar to the sensors 202 as described herein above. In some embodiments, the space controller 208 may not include a sensor. The communications interface 312 may include wired or wireless interfaces (e.g., jacks, antennas, transmitters, receivers, transceivers, wire terminals, etc.) for conducting data communications with various systems, devices, or networks. For example, the communications interface 312 may include an Ethernet card and port for sending and receiving data via an Ethernet-based communications network and/or a Wi-Fi transceiver for communicating via a wireless communications network. The communications interface 312 may be configured to communicate via local area networks or wide area networks (e.g., the Internet, a building WAN, etc.) and may use a variety of communications protocols (e.g., BACnet, IP, LON, etc.). The communications interface 312 may include a network interface configured to facilitate electronic data communications between the space controller 208 and various external systems or devices (e.g., a communications network, sensors 202, setpoint units 204, dampers 206, HVAC equipment 320, and user devices 322, etc.). For example, space controller 208 can communicate with sensors 202, setpoint units 204, dampers 206, HVAC equipment 320, user devices 322 via WiFi, Bluetooth, Zigbee, SA Bus, NFC, etc.

The processing circuit 306 is shown to include a processor 308 and a memory 310. In some embodiments, the processor 308 can be a specific purpose processor, a general purpose processor, an application specific integrated circuit (ASIC), one or more field programmable gate arrays (FPGAs), a group of processing components, or other suitable processing components. The processor 308 may be configured to execute computer code or instructions stored in memory or received from other computer readable media (e.g., CDROM, network storage, a remote server, etc.). The memory 310 may include one or more devices (e.g., memory units, memory devices, storage devices, etc.) for storing data and/or computer code for completing and/or facilitating the various processes described in the present disclosure. The memory 310 may include random access memory (RAM), read-only memory (ROM), hard drive storage, temporary storage, non-volatile memory, flash memory, optical memory, or any other suitable memory for storing software objects and/or computer instructions. The memory 310 may include database components, object code components, script components, or any other type of information structure for supporting the various activities and information structures described in the present disclosure. The memory 310 may be communicably connected to the processor via the processing circuit and may include computer code for executing (e.g., by the processor) one or more processes described herein. In some embodiments, the memory 310 can include at least a data obtaining module 330, a training module 332, a damper control module 334, and data storage 336. In other embodiments, more, less, or different modules or components can be stored in memory 310. In some embodiments, modules 330, 332, and 334 stored in a non-transitory computer readable medium (e.g., memory 310) can be executed by the processor 308 to perform operations as described herein below.

In some embodiments, the space controller 208 can obtain various data to control the HVAC system of the unit 20. For example, the processor 308 can execute the data obtaining module 330 to obtain various data. In some embodiments, the data obtaining module 330 can be configured to periodically (e.g., 1 second, 5 seconds, 10 seconds, 20 seconds, 1 minute, etc.) receive or obtain desired or target setpoints for a room, space or zone from a setpoint unit 204, sensor measurement values from sensors 202, and/or damper positions information from dampers 206 as described herein above via communications interface 312. In some embodiments, the damper positions can include positions of fully open, fully closed, and somewhere in between (e.g., 20% open, 50% open, 75% open, etc.). In some embodiments, the obtained or received data can be stored in data storage 336.

In some embodiments, the space controller 208 can use neural network based control process to control multiple sensors 202 and dampers 206 to achieve optimal, fast, effective and efficient temperature (or other parameters) control results. Such a neural network based control process or algorithm can also allow control of whatever number of sensors and dampers in the system and can avoid tedious configuration to map between sensors and dampers. In some embodiments, the training module 332 can be configured to determine a [n×m] matrix to distribute energy among the dampers 206 in the unit 20, where n (an integer) is the numbers of sensors in a system (e.g., unit 20) including multiple zones, and m (an integer) is the number of dampers 206 in the system. In the example of unit 20 in FIG. 2, which includes 6 rooms/zones (e.g., bedroom 1, bedroom 2, bathroom, kitchen, dining room, and living room), the matrix is a [7×9]=63 entries matrix (i.e., totally 63 entries or elements in the matrix) because there are 7 sensors 202 and 9 dampers 206 in the unit 20. For simplicity reasons and illustrative purposes, the following description assumes that the unit 20 has 3 rooms/zones, 4 sensors 202 (one room/zone has two sensors and the other two rooms/zones each has one sensor), and 3 dampers (each room/zone has one damper). Thus, in this example, a [4×3]=12 entries matrix is to be determined.

Continuing with the above [4×3] matrix example, the training module 332 can be configured to obtain two arrays. For example, the training module 332 can be configured to obtain data from the data storage 336 or receive data directly from the data obtaining module 330 and determine values of the two arrays. In some embodiments, the first array is an array of desired temperature gaps (differences, errors) for each sensor: $\Delta T=(t_1, t_2, \ldots t_n)$, where each t in the array represents the difference between the measurement value of a sensor n (e.g., temperature sensed by the sensor n) and the setpoint associated with the sensor n (e.g., set up by a user) at a given time. For example, if the first sensor 202A's measurement value is 75° F. and the setpoint associated with the first sensor 202A is 70° F., $t_1$=5° F. As an example for the four sensors, $\Delta T=(t_1=5°$ F., $t_2=0°$ F., $t_3=2°$ F., $t_4=3°$ F.).

In some embodiments, the second array is an array of damper statuses or positions: $D=(d_1, d_2 \ldots d_m)^T$, where each d in the array represents the damper position for a damper m at a given time T. As an example for the three dampers, $D=(d_1$=fully open, $d_2$=fully closed, $d_3$=half open$)^T$. With the above two arrays, an internal matrix [n×m] A has a relationship $\Delta T=A\times D$.

In some embodiments, the training module 332 can be configured to vary or adjust the damper positions of the dampers in the damper position array (second array) and to observe the sensor output changes of each of the sensors in the sensor array (first array). Over time, with many of such operations/experiments (as can be understood, computers such as the processor 308 can get this done very fast) and through backpropagation to tune the internal parameters or entries $A_{i,j}$ (where max i=n and max j=m in the [n×m] matrix) in the matrix, a [n×m] matrix A can be obtained, where the value of each internal parameter or entry $A_{i,j}$ of the matrix A can more accurately represent the distribution of energy of the system (e.g., unit 20 in FIG. 2) through those dampers in the damper position array (second array).

In some embodiments, once the values of the [n×m] matrix A are obtained or determined, the space controller 208 can use the equation $$A^{-1}\times\Delta T\ \left(\text{or}\ \frac{\Delta T}{A}\right)$$

to get an appropriate setting for the dampers to meet the desired setpoints of the unit 20

$$\left(\text{i.e., by } D=\frac{\Delta T}{A}\right).$$

For example, the damper control module 334, executed by the processor 308, can determine the optimal damper positions based on the equation $A^{-1}\times\Delta T$. Once the optimal damper positions are determined, the damper control module 334 can instruct or control the dampers and/or other HVAC equipment (e.g., actuators) to perform suitable operations.

By using the neural network based control process or algorithm, there is no need to configure which damper corresponds to which sensor in the system (e.g., unit 20). The space controller 208 can automatically determine the optimal damper position for each damper in the system (e.g., unit 20) based on the values of the [n×m] matrix A determined using the training process as described herein above. Such a control mechanism allows whatever number of sensors and dampers to be plugged in and desired setpoints to be set for each sensor. The space controller can utilize readings from all sensors and continuously calculate proper damper positions using the neural network based algorithm.

Figure 4:
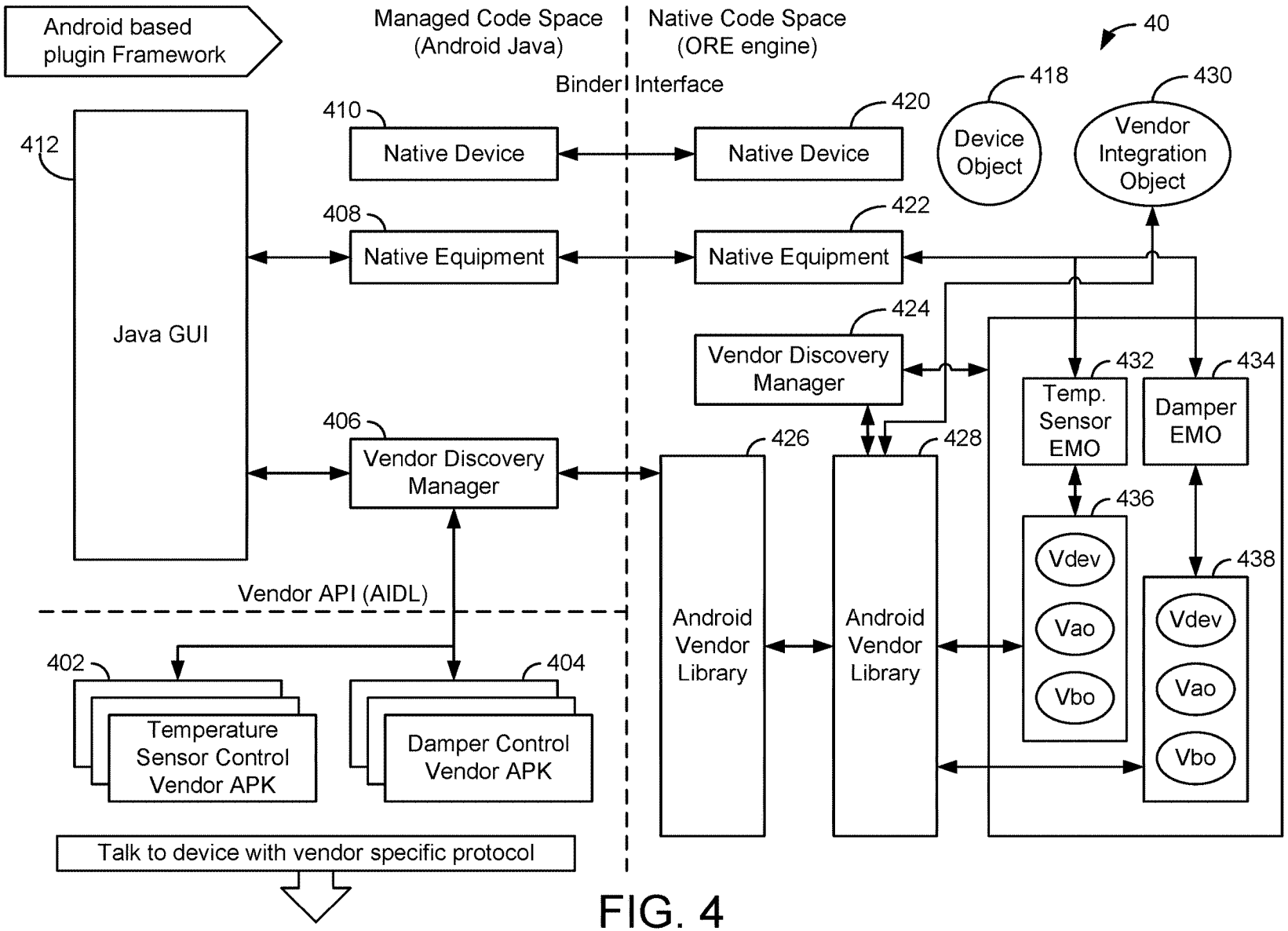
FIG. 4 is a block diagram illustrating a system architecture of converting data and objects to be used by the systems and methods of the present disclosure, according to an exemplary embodiment.

FIG. 4 is a block diagram 40 illustrating a system architecture of converting data and objects to be used by the systems and methods of the present disclosure, according to an exemplary embodiment. As noted above, in order to fully utilize different wireless sensors available in the market, it is desirable to have a platform that can easily plug in a variety of wireless sensors from different manufactures. In some embodiments, the system architecture as illustrated in FIG. 4 can enable such functionalities. Referring to FIG. 4, vendor provided application packages (APKs) (e.g., temperature sensor control vendor APK 402, damper control vendor APK 404, etc.) can be provided to the android based plugin framework. In some embodiments, vendor integration manager 406 can perform vendor discovery and provide application program interfaces (APIs) that can be used by the vendor provided APKs. Vendor integration manager 406 can then talk to components in right side of the diagram, which are in the native code space (object runtime environment (ORE)) of the systems and methods of the present disclosure.

In some embodiments, the vendor integration manager 406 can communicate with the android vendor library 426, the vendor integration server 428, and vendor discovery manager 424 to translate vendor provided APK data into the BACnet objects. For example, the BACnet objects as shown in FIG. 4 may include vendor integration object 430, device object 418, temperature sensor equipment model object 432 and damper equipment model object 434 each is associated with a set of vendor device object, vendor analog object, and vendor binary object 436, 438. In some embodiments, Java GUI 412 can communicate with vendor integration manager 406 and IEquipment 408 to facilitate the translation. In some embodiments, IEquipment 408 can communicate with Native Equipment 422 and IDevice 410 can communicate with Native Device 420 to facilitate the translation. The system architecture as described herein in relation to FIG. 4 can allow any accessories that can be controlled on Android to be plugged into for example the space controller as described herein in the present disclosure. For example, a generic temperature profile plugin (e.g., a Generic Attribute Profile (GATT) temperature profile plugin) can enable the space controller to use any Bluetooth Low Energy (BLE) temperature sensors on the market. Any other WiFi/BLE based sensors/dampers can also be easily plugged in with an Android APK.

Figure 5:
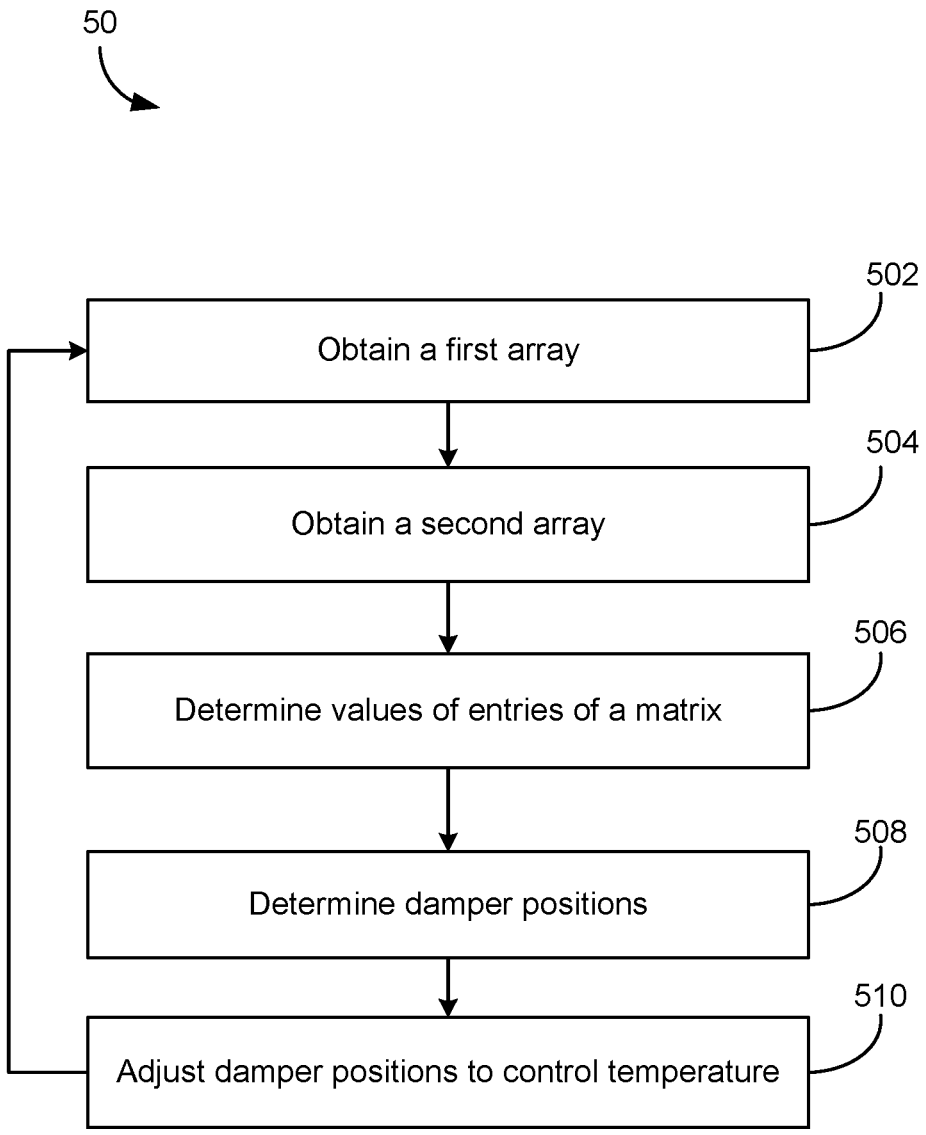
FIG. 5 is a flow diagram depicting a process for performing the multi-zone control process, according to an exemplary embodiment.

FIG. 5 is a flow diagram depicting a process 50 for performing the multi-zone control process, according to an exemplary embodiment. In some embodiments, process 50 can be performed by a controller (e.g., space controller 208). In step 502, a controller can obtain a first array associated with a plurality of sensors. The plurality of sensors can be configured to sense temperatures of a plurality of zones. In some embodiments, each element in the first array can represent a difference between a measurement value of a respective sensor and a setpoint associated with the respective sensor. In step 504, the controller can obtain a second array associated with a plurality of dampers. The plurality of dampers can be configured to control the temperatures of the plurality of zones by adjusting respective damper positions. In some embodiments, each element in the second array can represent a damper position of a respective damper. In step 506, the controller can determine values of entries of a matrix using the first array and the second array. In some embodiments, the values of entries of the matrix can be determined using a neural network based control process or algorithm as described herein above in relation to FIG. 3. In step 508, in response to a request to adjust temperature in a first zone associated with a first sensor, the controller can determine the damper positions of the plurality of dampers using the values of the entries of the matrix and a difference between a temperature sensed by the first sensor and a setpoint associated with the first sensor. For example, the request can be received from the first sensor as a result that the first sensor detects that the temperature in the first zone becomes different from the setpoint. For example, the request can be received from a mechanism for setting desired setpoints (e.g., setpoint unit 204) when the setpoint is adjusted (e.g., by a user). In some embodiments, the damper positions of the plurality of dampers can be determined using the values of the entries of the matrix and the values of the elements of the first array (e.g., differences between respective temperatures sensed by the sensors and respective setpoints associated with the sensors). In step 510, the controller can instruct, command, or control HVAC equipment (e.g., actuators) to adjust damper positions to control the temperature of the first zone. In some embodiments, the process of multi-zone control can repeat iteratively or continuously to refine the values of the entries of the matrix or the model as the dampers are being operated.

Figure 6:
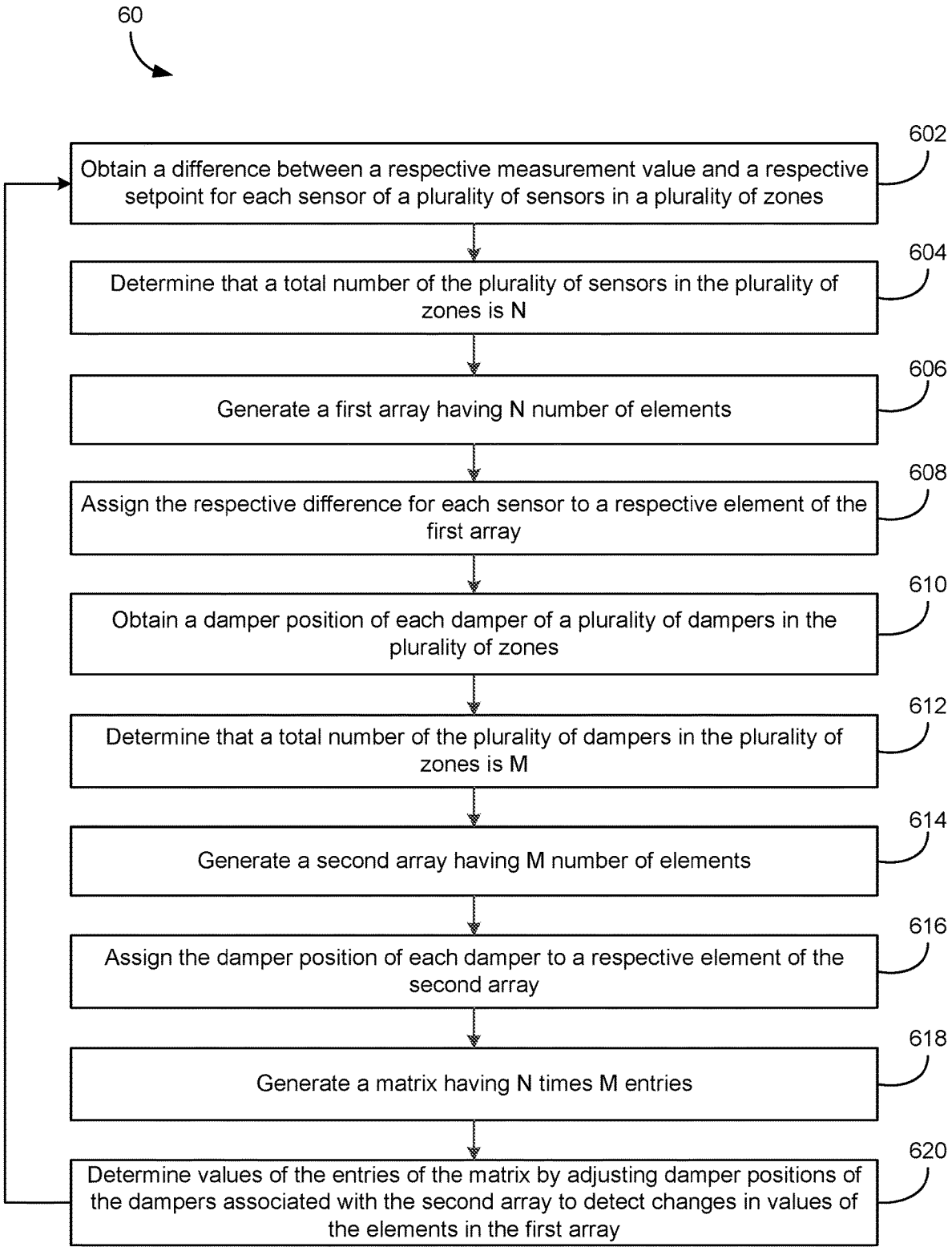
FIG. 6 is a flow diagram depicting a process for generating a neural network based model or matrix for multi-zone control, according to an exemplary embodiment.

FIG. 6 is a flow diagram depicting a process 60 for generating a neural network based model or matrix for multi-zone control, according to an exemplary embodiment. In some embodiments, process 60 can be performed by a controller (e.g., space controller 208). In some embodiments, process 60 can be performed when the sensors or dampers are installed or when one or more sensors or dampers are added into or removed from the plurality of zones of the system. In some embodiments, process 60 can be performed periodically or when/after dampers are operated to continuously refine the model.

Referring to FIG. 6, in step 602, a controller can obtain a difference between a respective measurement value and a respective setpoint for each sensor of a plurality of sensors (e.g., sensors 202) in a plurality of zones of the system (e.g., unit 20). In some embodiments, the controller can obtain or receive a measurement value of the temperature (or other parameters) from each sensor of the plurality of sensors through a communication interface (e.g., communications interface 312) via wired (e.g., Ethernet) or wireless (e.g., Wi-Fi, Bluetooth, ZigBee, NFC) connections. In some embodiments, the controller can obtain or receive a setpoint associated with each sensor of the plurality of sensors through the communication interface via wired or wireless connections, for example, from setpoint units 204. In other embodiments, one or more of the sensors and/or the setpoint units may be integrated in the controller. In some embodiments, the controller can determine a difference between the respective measurement value and the respective setpoint for each sensor. For example, if the measurement value obtained from a sensor is 72° F. and the setpoint associated with the sensor is 70° F., the difference is 2° F.

In step 604, the controller can determine the total number of sensors in the plurality of zones. For example, if there are N sensors in the plurality of zones, the controller determines that the total number of sensors in the plurality of zones is N, where N is an integer (e.g., 2, 5, 8, 10, 20). In step 606, the controller can generate a first array having N number of elements. For example, if there are 6 sensors in the multiple zones, the controller can generate a first array of 6 elements. In step 608, the controller can assign the respective difference for each sensor obtained in step 602 to a respective element of the first array. Continuing with the above example, a first array of 6 elements {2° F., 1° F., 3° F., 0° F., 1° F., 3° F.} can be obtained.

In step 610, the controller can obtain a damper position of each damper of the plurality of dampers (e.g., dampers 206) in the plurality of zones of the system (e.g., unit 20). In some embodiments, the controller can obtain or receive a damper position of each damper of the plurality of dampers through a communication interface (e.g., communications interface 312) via wired (e.g., Ethernet) or wireless (e.g., Wi-Fi, Bluetooth, ZigBee, NFC) connections. In some embodiments, an actuator that controls or operates the damper can send a signal to the controller to report the damper position of the damper. In some embodiments, the actuator can communicate with the controller via wired (e.g., Ethernet) or wireless (e.g., Wi-Fi, Bluetooth, ZigBee, NFC) connections.

In step 612, the controller can determine the total number of dampers in the plurality of zones. For example, if there are M dampers in the plurality of zones, the controller determines that the total number of dampers in the plurality of zones is M, where M is an integer (e.g., 2, 5, 9, 15, 25). In step 614, the controller can generate a second array having M number of elements. For example, if there are 5 dampers in the multiple zones, the controller can generate a second array of 5 elements. In step 616, the controller can assign the damper position of each damper obtained in step 610 to a respective element of the second array. For example, a second array of 5 elements {fully open, full closed, half open, 20% open, 65% open} can be obtained.

In step 618, the controller can generate a matrix having N times M (N×M) entries. For example, if the total number of sensors in the plurality of zones is N and the total number of dampers in the plurality of zones is M, a matrix of (N×M) entries can be generated. Continuing with the above example, if there are 6 sensors and 5 dampers in the plurality of zones, a matrix of 30 (6 times 5) entries can be generated. In step 620, the controller can determine values of the entries of the matrix. In some embodiments, the values of the entries of the matrix can be determined by adjusting damper positions of the dampers associated with the second array to detect changes in values of the elements in the first array. For example, the controller can send commands to the actuators associated with the dampers to adjust the damper positions of the dampers. The controller can then observe or detect what changes are made in the values of the elements in the first array. For example, a temperature difference associated with a first sensor in the first array might be changed from 3° F. to 2° F. while a temperature difference associated with a second sensor in the first array might be changed from 3° F. to 0° F. The operations of adjustment/observation (detection)/adjustment can be performed iteratively or repeatedly in a short time period by the controller. Thus, with many of such operations/experiments and through backpropagation to tune the entries $A_{i,j}$ in the matrix (where max i=N and max j=M in the [N×M] matrix), a [N×M] matrix A can be obtained, where the value of each entry $A_{i,j}$ of the matrix A can more accurately represent the distribution of energy of the system through the dampers of the second array.

Figure 7:
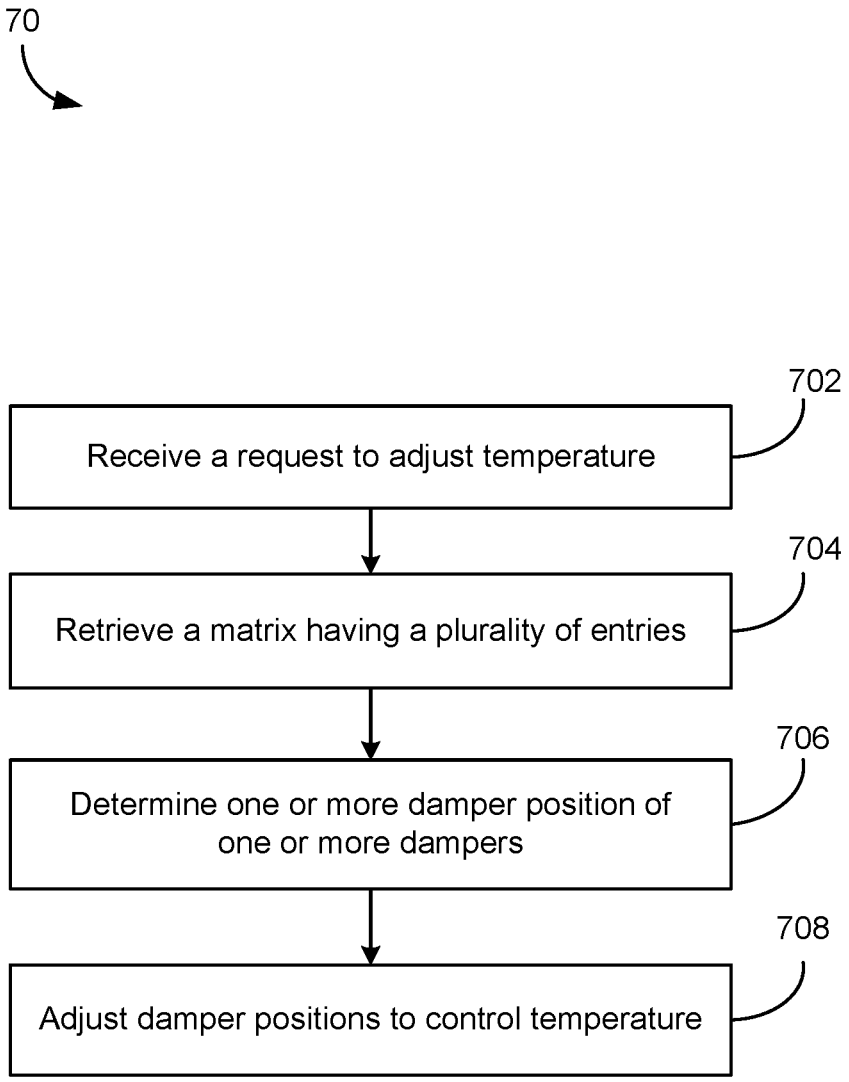
FIG. 7 is a flow diagram depicting a process for multi-zone control using a neural network based model or matrix, according to an exemplary embodiment.

FIG. 7 is a flow diagram depicting a process 70 for multi-zone control using the neural network based model or matrix generated in relation to FIGS. 3 and 6, according to an exemplary embodiment. In some embodiments, process 70 can be performed by a controller (e.g., space controller 208). In step 702, a controller can receive a request to adjust temperature in a first zone associated with a first sensor. For example, the request can be received from the first sensor as a result that the first sensor detects that the temperature in the first zone becomes different from the setpoint. For example, the request can be received from a mechanism for setting desired setpoints (e.g., setpoint unit 204) when the setpoint is adjusted (e.g., by a user). In some embodiments, the first zone is among a plurality of zones, and the first sensor is among a plurality of sensors configured to sense temperatures of a plurality of zones.

In step 704, responsive to receiving the request, the controller can retrieve or obtain a matrix having a plurality of entries. In some embodiments, the matrix can be stored in a memory or data storage (e.g., data storage 336) of the controller. In other embodiments, the matrix can be stored in a data storage or memory of another device. In some embodiments, the matrix can be generated dynamically responsive to receiving the request. In some embodiments, the matrix has N times M entries, where N and M are integers, as described herein above in relation to FIG. 6. In some embodiments, the plurality of zones include N number of sensors and M number of dampers.

In step 706, the controller can determine one or more damper positions of one or more dampers associated with the first sensor based on one or more entries in the matrix and a difference between a temperature sensed by the first sensor and a setpoint associated with the first sensor. For example, the controller can determine a damper position for a first damper using the equation $$D = \frac{\Delta T}{A} (\text{or } D = A^{-1} \times \Delta T),$$

where D is the damper position for the first damper, A is the value of an entry corresponding to the first sensor and the first damper in the matrix, and ΔT is the difference between a temperature sensed by the first sensor and a setpoint associated with the first sensor.

In step 708, the controller can instruct, command, or control HVAC equipment to adjust the damper position of the first damper based on the determined damper position to control the temperature of the first zone. For example, the controller can instruct an actuator that controls or operates the damper to adjust the damper position (e.g., from half open to 80% open) by transmitting a signal to the actuator.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system comprising:

a plurality of sensors configured to sense temperatures of a plurality of zones;

a plurality of dampers configured to control the temperatures of the plurality of zones by adjusting respective damper positions; and a controller configured to:

obtain a first array associated with the plurality of sensors, wherein each element in the first array represents a difference between a measurement value of a respective sensor and a setpoint associated with the respective sensor;

obtain a second array associated with the plurality of dampers, wherein each element in the second array represents a damper position of a respective damper; and determine values of entries of a matrix based on adjusting the respective damper positions of the dampers associated with the second array to detect changes in values of elements in the first array.

2. The system of claim 1, wherein the controller is further configured to determine target damper positions of the plurality of dampers using the values of the entries of the matrix responsive to a request to adjust temperature in a first zone associated with a first sensor.

3. The system of claim 2, wherein the damper positions of the plurality of dampers are determined further based at least in part on a difference between a temperature sensed by the first sensor and a setpoint associated with the first sensor.

4. The system of claim 2, wherein the controller is configured to instruct HVAC equipment to adjust the respective damper positions based on the determined target damper positions to control the temperature of the first zone.

5. The system of claim 1, wherein the controller is configured to obtain the first array by:

obtaining a measurement value of each sensor of the plurality of sensors;

obtaining a setpoint associated with each sensor of the plurality of sensors;

determining a difference between the respective measurement value and the respective setpoint for each sensor;

determining that a total number of the plurality of sensors in the plurality of zones is N, wherein N is an integer;

generating the first array having N number of elements; and assigning the respective difference between the respective measurement value and the respective setpoint to a respective element of the first array.

6. The system of claim 1, wherein the controller is configured to obtain the second array by:

obtaining the damper position of each damper of the plurality of dampers;

determining that a total number of the plurality of dampers in the plurality of zones is M, wherein M is an integer;

generating the second array having M number of elements; and assigning a respective damper position associated with each damper to a respective element of the second array.

7. The system of claim 6, wherein the damper position is obtained based on a signal received from an actuator associated with the respective damper.

8. The system of claim 1, wherein the controller is configured to:

determine that a total number of the plurality of sensors in the plurality of zones is N, wherein N is an integer;

generate the first array having N number of elements;

determine that a total number of the plurality of dampers in the plurality of zones is M, wherein M is an integer;

generate the second array having M number of elements; and generate the matrix having N times M entries.

9. A method comprising:

obtaining, by a controller, a first array associated with a plurality of sensors configured to sense temperatures of a plurality of zones, wherein each element in the first array represents a difference between a measurement value of a respective sensor and a setpoint associated with the respective sensor;

obtaining, by the controller, a second array associated with a plurality of dampers configured to control the temperatures of the plurality of zones by adjusting respective damper positions, wherein each element in the second array represents a damper position of a respective damper; and determining, by the controller, values of entries of a matrix based on adjusting the respective damper positions of the dampers associated with the second array to detect changes in values of elements in the first array.

10. The method of claim 9, further comprising:

responsive to a request to adjust temperature in a first zone associated with a first sensor, determining the damper positions of the plurality of dampers using the values of the entries of the matrix.

11. The method of claim 10, wherein the damper positions of the plurality of dampers are determined further based at least in part on a difference between a temperature sensed by the first sensor and a setpoint associated with the first sensor.

12. The method of claim 10, further comprising:

instructing, by the controller, HVAC equipment to adjust the damper positions based on the determined damper positions to control the temperature of the first zone.

13. The method of claim 9, wherein obtaining the first array further comprising:

obtaining a measurement value of each sensor of the plurality of sensors;

obtaining a setpoint associated with each sensor of the plurality of sensors;

determining a difference between the respective measurement value and the respective setpoint for each sensor;

determining that a total number of the plurality of sensors is N, wherein N is an integer;

generating the first array having N number of elements; and assigning the respective difference between the respective measurement value and the respective setpoint to a respective element of the first array.

14. The method of claim 9, wherein obtaining the second array further comprising:

obtaining the damper position of each damper of the plurality of dampers;

determining that a total number of the plurality of dampers is M, wherein M is an integer;

generating the second array having M number of elements; and assigning a respective damper position associated with each damper to a respective element of the second array.

15. The method of claim 9, further comprising:

determining that a total number of the plurality of sensors is N, wherein N is an integer;

generating the first array having N number of elements;

determining that a total number of the plurality of dampers is M, wherein M is an integer;

generating the second array having M number of elements;

generating the matrix having N times M entries; and determining the values of the entries of the matrix by adjusting the respective damper positions of the dampers associated with the second array to detect changes in values of elements in the first array.

16. A method comprising:

receiving a request to adjust temperature in a first zone associated with a first sensor, wherein the first zone is among a plurality of zones, and the first sensor is among a plurality of sensors configured to sense temperatures of the plurality of zones;

responsive to receiving the request, retrieving a matrix having a plurality of entries; and determining a damper position of a damper associated with the first sensor based on an entry in the matrix and a difference between a temperature sensed by the first sensor and a setpoint associated with the first sensor.

17. The method of claim 16, wherein the entry in the matrix corresponds to the damper and the first sensor.

18. The method of claim 16, wherein the matrix has N times M entries, N and M being integers, wherein a total number of the plurality of sensors is N, and wherein the plurality of zones include M dampers, and the damper is among the M dampers.

19. The method of claim 16, further comprising:

instructing HVAC equipment to adjust the damper position of the damper based on the determined damper position to control the temperature of the first zone.

* * * * *